US010446299B2

(12) United States Patent
Yang et al.

(10) Patent No.: US 10,446,299 B2
(45) Date of Patent: Oct. 15, 2019

(54) VARISTOR HAVING MULTILAYER COATING AND FABRICATION METHOD

(71) Applicant: Dongguan Littelfuse Electronics, Co., Ltd., GuangDong (CN)

(72) Inventors: Wen Yang, Guangdong Province (CN); Hao Cheng, Shaanxi Province (CN)

(73) Assignee: Dongguan Littelfuse Electronics Company Limited, GuangDong (CN)

( * ) Notice: Subject to any disclaimer, the term of this patent is extended or adjusted under 35 U.S.C. 154(b) by 0 days.

(21) Appl. No.: 15/501,118

(22) PCT Filed: Mar. 6, 2015

(86) PCT No.: PCT/CN2015/073739
§ 371 (c)(1),
(2) Date: Feb. 1, 2017

(87) PCT Pub. No.: WO2016/019723
PCT Pub. Date: Feb. 11, 2016

(65) Prior Publication Data

US 2017/0221613 A1 Aug. 3, 2017

(30) Foreign Application Priority Data

Aug. 8, 2014 (WO) ..... PCT/CN2014/083974

(51) Int. Cl.

| | |
|---|---|
| ***H01C 7/112*** | (2006.01) |
| ***H01C 7/102*** | (2006.01) |
| ***H01C 17/065*** | (2006.01) |
| ***H01C 1/032*** | (2006.01) |
| ***H01C 17/02*** | (2006.01) |
| *H01C 17/28* | (2006.01) |

(52) U.S. Cl.
CPC ..... *H01C 7/112* (2013.01); *H01C 1/032* (2013.01); *H01C 7/102* (2013.01); *H01C 17/02* (2013.01); *H01C 17/06546* (2013.01); *H01C 17/06586* (2013.01); *H01C 17/285* (2013.01)

(58) Field of Classification Search
CPC ..... H01C 7/112; H01C 1/032; H01C 17/02
USPC ..... 338/20
See application file for complete search history.

(56) References Cited

U.S. PATENT DOCUMENTS 4,039,904 A 8/1977 Klein et al.
4,559,167 A 12/1985 Jelke et al.
(Continued)

FOREIGN PATENT DOCUMENTS

CN 1434464 A 8/2003
CN 1481560 3/2004
(Continued)

OTHER PUBLICATIONS

International Search Report for the International Application No. PCT/CN2014/083974, dated Mar. 30, 2015, 4 pages.
(Continued)

*Primary Examiner* — Kyung S Lee
*Assistant Examiner* — Iman Malakooti

(57) ABSTRACT

In one embodiment a varistor may include a ceramic body. The varistor may further comprise a multilayer coating disposed around the ceramic body. The multilayer coating may include a first layer comprising a phenolic material or a silicone material; and a second layer adjacent the first layer, the second layer comprising a high dielectric strength coating.

17 Claims, 9 Drawing Sheets

(56) References Cited

U.S. PATENT DOCUMENTS

| | | | | |
|---|---|---|---|---|
| 5,008,646 | A * | 4/1991 | Hennings | H01C 7/112 252/512 |
| 6,201,290 | B1 * | 3/2001 | Yamada et al. | H01O 27/02 257/536 |
| 8,562,859 | B2 * | 10/2013 | Kato | H01C 17/06546 252/182.33 |
| 2003/0150741 | A1 | 8/2003 | Wu | |
| 2005/0088273 | A1 | 4/2005 | Kitsui et al. | |
| 2007/0025044 | A1 | 2/2007 | Golubovic et al. | |
| 2009/0006569 | A1 | 1/2009 | Morss et al. | |
| 2010/0157492 | A1 * | 6/2010 | Tan | H01C 1/14 361/56 |
| 2010/0170626 | A1 | 7/2010 | Lochtman et al. | |
| 2011/0274831 | A1 | 11/2011 | Saegusa et al. | |
| 2012/0223798 | A1 | 9/2012 | Wei | |
| 2013/0162100 | A1 * | 6/2013 | Kang | H01F 17/0013 310/311 |
| 2014/0111300 | A1 * | 4/2014 | Park | H01G 4/30 338/22 R |
| 2014/0124251 | A1 | 5/2014 | Park et al. | |

FOREIGN PATENT DOCUMENTS

| | | | | |
|---|---|---|---|---|
| CN | 1905086 | A | 1/2007 | |
| CN | 101556850 | A | 10/2009 | |
| CN | 101620901 | A | 1/2010 | |
| CN | 102024541 | * | 4/2011 | H01C 7/10 |
| CN | 102024541 | A | 4/2011 | |
| CN | 102318016 | A | 1/2012 | |
| CN | 102347296 | A | 2/2012 | |
| CN | 102664082 | A | 9/2012 | |
| CN | 102665082 | A | 9/2012 | |
| DE | 10 2012 109704 | A1 | 4/2014 | |
| JP | H05109506 | A | 4/1993 | |
| JP | 2001284103 | | 10/2001 | |
| JP | 2004095609 | | 3/2004 | |
| JP | 05109506 | | 4/2005 | |
| JP | 2005150516 | A | 6/2005 | |
| JP | 2005243746 | | 9/2005 | |
| JP | 2009088168 | A | 4/2009 | |
| JP | 2009246114 | | 10/2009 | |
| JP | 5157349 | B2 | 3/2013 | |
| JP | 5297163 | | 9/2013 | |
| JP | 5364285 | B2 | 12/2013 | |
| WO | 2013170648 | A1 | 11/2013 | |
| WO | 2014120880 | A1 | 8/2014 | |

OTHER PUBLICATIONS

International Search Report for the International Application No. PCT/CN2015/073739, dated Jun. 23, 2015, 4 pages.

European Search Report and Search Opinion, dated May 28, 2018, for the European Application No. 15830254 (6 pages).

European Search Report and Search Opinion, dated May 4, 2018, for European Application No. 14899196 (6 pages).

* cited by examiner

| | | 25S-DC 970V SILICONE BASED | | | |
|---|---|---|---|---|---|
| | | INITIAL | | | |
| | | Vnom@1mA | | LEAKAGE | |
| | | FORWARD | REVERSE | FORWARD | REVERSE |
| 125C LOADING | 1 | 1170 | 1173 | 17.34 | 15.35 |
| | 2 | 1220 | 1223 | 15.55 | 13.02 |
| | 3 | 1190 | 1193 | 16.78 | 14.66 |
| | 4 | 1245 | 1249 | 15.10 | 12.44 |
| | 5 | 1191 | 1193 | 16.75 | 14.60 |
| | 6 | 1235 | 1238 | 16.88 | 14.43 |
| | 7 | 1167 | 1166 | 17.28 | 15.15 |
| | 8 | 1184 | 1187 | 16.83 | 14.76 |
| | 9 | 1167 | 1170 | 15.90 | 13.65 |
| | 10 | 1201 | 1204 | 15.17 | 12.86 |
| 85C 85H% BIASED HUMIDITY | 11 | 1181 | 1184 | 17.00 | 14.88 |
| | 12 | 1233 | 1238 | 20.15 | 18.53 |
| | 13 | 1223 | 1223 | 15.22 | 12.76 |
| | 14 | 1170 | 1174 | 17.88 | 15.86 |
| | 15 | 1219 | 1224 | 15.34 | 12.94 |
| | 16 | 1188 | 1191 | 17.48 | 15.41 |
| | 17 | 1196 | 1199 | 16.11 | 13.88 |
| | 18 | 1170 | 1172 | 17.63 | 15.70 |
| | 19 | 1164 | 1167 | 22.50 | 21.84 |
| | 20 | 1197 | 1200 | 16.47 | 14.30 |
| | MAX | 1245.00 | 1249.00 | 22.50 | 21.84 |
| | MIN | 1164.00 | 1166.00 | 15.10 | 12.44 |
| | ST-DEV | 25.52 | 25.98 | 1.76 | 2.16 |
| | AVER | 1195.55 | 1198.40 | 16.97 | 14.85 |

FIG. 3A

| | 168H | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 1 | 1181 | 1199 | 9.43 | 6.52 | 0.94 | 2.22 |
| 2 | 1233 | 1252 | 8.13 | 5.45 | 1.07 | 2.37 |
| 3 | 1202 | 1221 | 9.19 | 6.36 | 1.01 | 2.35 |
| 4 | 1259 | 1277 | 8.02 | 5.44 | 1.12 | 2.24 |
| 5 | 1202 | 1220 | 9.18 | 6.33 | 0.92 | 2.26 |
| 6 | 1254 | 1271 | 8.55 | 5.85 | 1.54 | 2.67 |
| 7 | 1178 | 1196 | 8.91 | 5.84 | 0.94 | 2.57 |
| 8 | 1196 | 1225 | 9.17 | 5.58 | 1.01 | 3.20 |
| 9 | 1185 | 1201 | 8.33 | 5.59 | 1.54 | 2.65 |
| 10 | 1218 | 1234 | 7.85 | 5.48 | 1.42 | 2.49 |
| 11 | 1187 | 1203 | 26.58 | 12.17 | 0.51 | 1.60 |
| 12 | 1239 | 1252 | 15.21 | 9.75 | 0.49 | 1.13 |
| 13 | 1228 | 1239 | 14.97 | 8.75 | 0.41 | 1.31 |
| 14 | 1177 | 1193 | 15.12 | 9.77 | 0.60 | 1.62 |
| 15 | 1226 | 1240 | 21.37 | 10.71 | 0.57 | 1.31 |
| 16 | 1194 | 1208 | 12.98 | 9.18 | 0.51 | 1.43 |
| 17 | 1203 | 1217 | 11.21 | 8.03 | 0.59 | 1.50 |
| 18 | 1176 | 1191 | 13.23 | 9.17 | 0.51 | 1.62 |
| 19 | 1172 | 1188 | 17.46 | 11.22 | 0.69 | 1.80 |
| 20 | 1203 | 1218 | 15.66 | 9.7 | 0.50 | 1.50 |
| | 1259.00 | 1277.00 | 26.58 | 12.17 | 1.54 | 3.20 |
| | 1172.00 | 1188.00 | 7.85 | 5.44 | 0.41 | 1.13 |
| | 26.52 | 26.36 | 5.04 | 2.24 | 0.36 | 0.58 |
| | 1205.65 | 1222.25 | 12.53 | 7.84 | 0.84 | 1.99 |

FIG. 3B

| | 336Hrs | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 1 | 1195 | 1228 | 9.31 | 6.22 | 2.14 | 4.69 |
| 2 | 1245 | 1280 | 8.34 | 5.34 | 2.05 | 4.66 |
| 3 | 1215 | 1249 | 9.17 | 6.12 | 2.10 | 4.69 |
| 4 | 1271 | 1305 | 8.28 | 5.44 | 2.09 | 4.48 |
| 5 | 1215 | 1248 | 9.11 | 6.11 | 2.02 | 4.61 |
| 6 | 1270 | 1298 | 8.58 | 5.73 | 2.83 | 4.85 |
| 7 | 1186 | 1222 | 9.27 | 5.76 | 1.63 | 4.80 |
| 8 | 1210 | 1242 | 9.16 | 6.1 | 2.20 | 4.63 |
| 9 | 1191 | 1224 | 8.84 | 5.9 | 2.06 | 4.62 |
| 10 | 1224 | 1257 | 8.94 | 5.67 | 1.92 | 4.40 |
| 11 | 1165 | 1209 | 273.5 | 30.5 | -1.35 | 2.11 |
| 12 | 1249 | 1264 | 23.75 | 8.63 | 1.30 | 2.10 |
| 13 | 1221 | 1243 | 47.47 | 11.68 | -0.16 | 1.64 |
| 14 | 1179 | 1201 | 33.88 | 10.38 | 0.77 | 2.30 |
| 15 | 1215 | 1246 | 236.4 | 28 | -0.33 | 1.80 |
| 16 | 1197 | 1218 | 16.98 | 9.09 | 0.76 | 2.27 |
| 17 | 1218 | 1237 | 13.11 | 8.23 | 1.84 | 3.17 |
| 18 | 1179 | 1200 | 27.84 | 9.44 | 0.77 | 2.39 |
| 19 | 1173 | 1196 | 38.41 | 12.01 | 0.77 | 2.49 |
| 20 | 1204 | 1226 | 57.58 | 12.35 | 0.58 | 2.17 |
| | 1271.00 | 1305.00 | 273.50 | 30.50 | 2.83 | 4.85 |
| | 1165.00 | 1196.00 | 8.28 | 5.34 | -1.35 | 1.64 |
| | 30.07 | 30.50 | 74.22 | 7.02 | 1.05 | 1.27 |
| | 1211.10 | 1239.65 | 42.90 | 9.94 | 1.30 | 3.44 |

FIG. 3C

| | 500Hrs | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 1 | 1197 | 1233 | 8.65 | 5.74 | 2.31 | 5.12 |
| 2 | 1247 | 1286 | 7.8 | 4.97 | 2.21 | 5.15 |
| 3 | 1217 | 1254 | 8.52 | 5.64 | 2.27 | 5.11 |
| 4 | 1275 | 1310 | 7.67 | 4.76 | 2.41 | 4.88 |
| 5 | 1217 | 1253 | 8.45 | 5.59 | 2.18 | 5.03 |
| 6 | 1279 | 1301 | 8.69 | 5.82 | 3.56 | 5.09 |
| 7 | 1192 | 1228 | 8.71 | 5.08 | 2.14 | 5.32 |
| 8 | 1211 | 1247 | 8.51 | 5.65 | 2.28 | 5.05 |
| 9 | 1193 | 1228 | 8.27 | 5.44 | 2.23 | 4.96 |
| 10 | 1230 | 1263 | 7.61 | 5.03 | 2.41 | 4.90 |
| 11 | 1138 | 1219 | 365.8 | 39.3 | -3.64 | 2.96 |
| 12 | 1248 | 1266 | 28.2 | 9.54 | 1.22 | 2.26 |
| 13 | 1219 | 1246 | 100.9 | 17.2 | -0.33 | 1.88 |
| 14 | 1177 | 1205 | 73.9 | 13.42 | 0.60 | 2.64 |
| 15 | 1162 | 1244 | 363.8 | 45.3 | -4.68 | 1.63 |
| 16 | 1199 | 1227 | 17.43 | 8.63 | 0.93 | 3.02 |
| 17 | 1210 | 1231 | 15.45 | 7.75 | 1.17 | 2.67 |
| 18 | 1180 | 1204 | 36.58 | 9.26 | 0.85 | 2.73 |
| 19 | 1173 | 1200 | 57.19 | 13.48 | 0.77 | 2.83 |
| 20 | 1203 | 1230 | 89.73 | 14.67 | 0.50 | 2.50 |
| | 1279.00 | 1310.00 | 365.80 | 45.30 | 3.56 | 5.32 |
| | 1138.00 | 1200.00 | 7.61 | 4.76 | -4.68 | 1.63 |
| | 35.63 | 30.24 | 107.76 | 11.18 | 2.02 | 1.35 |
| | 1208.35 | 1243.75 | 61.59 | 11.61 | 1.07 | 3.79 |

FIG. 3D

| | INITIAL | | | |
|---|---|---|---|---|
| | Vnom@1mA | | LEAKAGE | |
| | FORWARD | REVERSE | FORWARD | REVERSE |
| 47 | 1180 | 1191 | 34.70 | 32.93 |
| 48 | 1187 | 1197 | 34.71 | 32.90 |
| 49 | 1168 | 1178 | 34.77 | 32.96 |
| 50 | 1180 | 1190 | 33.95 | 32.27 |
| 51 | 1213 | 1223 | 32.51 | 30.52 |
| MAX | 1213.00 | 1223.00 | 34.77 | 32.96 |
| MIN | 1168.00 | 1178.00 | 32.51 | 30.52 |
| ST-DEV | 16.77 | 16.69 | 0.97 | 1.04 |
| AVER | 1185.60 | 1195.80 | 34.13 | 32.32 |

FIG. 4A

| | 168H | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 47 | 813 | 1172 | 328.60 | 263.30 | -31.10 | -1.60 |
| 48 | 637 | 1091 | 490.10 | 400.60 | -46.34 | -8.86 |
| 49 | 834 | 1163 | 270.50 | 228.80 | -28.60 | -1.27 |
| 50 | 901 | 1190 | 355.10 | 191.30 | -23.64 | 0.00 |
| 51 | 940 | 1215 | 287.80 | 191.80 | -22.51 | -0.65 |
| MAX | 940.00 | 1215.00 | 490.10 | 400.60 | -22.51 | 0.00 |
| MIN | 637.00 | 1091.00 | 270.50 | 191.30 | -46.34 | -8.86 |
| ST-DEV | 116.80 | 46.49 | 86.94 | 86.61 | 9.56 | 3.62 |
| AVER | 825.00 | 1166.20 | 346.42 | 255.16 | -30.44 | -2.48 |

FIG. 4B

| | 336 Hrs | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 47 | 709 | 1198 | 480.60 | 305.20 | -39.92 | 0.59 |
| 48 | 539 | 1057 | 538.40 | 438.40 | -54.59 | -11.70 |
| 49 | 686 | 1150 | 423.30 | 318.30 | -41.27 | -2.38 |
| 50 | 673 | 1168 | 501.70 | 370.80 | -42.97 | -1.85 |
| 51 | 728 | 1182 | 432.50 | 333.10 | -39.98 | -3.35 |
| MAX | 728.00 | 1198.00 | 538.40 | 438.40 | -39.92 | 0.59 |
| MIN | 539.00 | 1057.00 | 423.30 | 305.20 | -54.59 | -11.70 |
| ST-DEV | 74.61 | 55.44 | 48.07 | 53.61 | 6.19 | 4.68 |
| AVER | 667.00 | 1151.00 | 475.30 | 353.16 | -43.74 | -3.74 |

FIG. 4C

| | 500 Hrs | | | | | |
|---|---|---|---|---|---|---|
| | Vnom@1mA | | LEAKAGE | | VNOM SHIFT | |
| | FORWARD | REVERSE | FORWARD | REVERSE | FORWARD | REVERSE |
| 47 | 501 | 1069 | 532.70 | 438.50 | -57.54 | -10.24 |
| 48 | | | | | | |
| 49 | 518 | 1073 | 518.70 | 425.60 | -55.65 | -8.91 |
| 50 | 554 | 1118 | 535.20 | 426.00 | -53.05 | -6.05 |
| 51 | 586 | 1146 | 503.20 | 414.50 | -51.69 | -6.30 |
| MAX | 586.00 | 1146.00 | 535.20 | 438.50 | -51.69 | -6.05 |
| MIN | 501.00 | 1069.00 | 503.20 | 414.50 | -57.54 | -10.24 |
| ST-DEV | 37.93 | 37.06 | 14.75 | 9.81 | 2.62 | 2.04 |
| AVER | 539.75 | 1101.50 | 522.45 | 426.15 | -54.48 | -7.88 |

FIG. 4D

| | MATERIALS | COMPOSITION |
|---|---|---|
| 502 | SILICONE MATERIAL | SILICONE DIOXIDE 40-80 wt %;<br>XYLENE 1-10 wt %;<br>ETHYLBENZENE 1-10 wt%;<br>NAPHTHA (PETROLEUM) 0-5 wt %;<br>IPA 0-3 wt%;<br>ALKYL SILICONE RESIN 0-15 wt%<br>ADDITIVE 0-10 wt% |
| 504 | PHENOLIC | PHENOLIC RESIN 40-80 wt %;<br>ACETONE 0-30 wt %;<br>IPA 0-30 wt %;<br>ADDITIVE 0-10 wt% |
| 506 | CONFORMAL COATING | ALKYD RESIN 30-70 wt %;<br>XYLENE 0-30 wt %;<br>OTHER SOLVENT 0-25 wt%;<br>ADDITIVE 0-5 wt% |

FIG. 5

VARISTOR HAVING MULTILAYER COATING AND FABRICATION METHOD

This application claims priority to PCT application number PCT/CN2014/083974, filed Aug. 8, 2014, and incorporated by reference herein in its entirety.

BACKGROUND

Field

Embodiments relate to the field of circuit protection devices, and more particularly to a metal oxide varistor for surge protection.

Discussion of Related Art

Over-voltage protection devices are used to protect electronic circuits and components from damage due to over-voltage fault conditions. These over-voltage protection devices may include metal oxide varistors (MOVs) that are connected between the circuits to be protected and a ground line. MOVs have a current-voltage characteristic that allows them to be used to protect such circuits against catastrophic voltage surges. Because varistor devices are so widely deployed to protect many different types of apparatus, there is a continuing need to improve properties of varistors.

An MOV device (the terms "MOV" and "varistor" are used interchangeably herein unless otherwise noted) is generally composed of a ceramic disc, often based upon ZnO, an electrical contact layer that acts as an electrode, such as a Ag (silver) electrode, and a first metal lead and second metal lead connected at a first surface and second surface, respectively, where the second surface opposes the first surface. The MOV device is also provided with an insulation coating that surrounds the ceramic disc and other materials in many cases. An example of an MOV found in the present market includes a ceramic disc that is coated with epoxy insulation, which has a high dielectric strength.

Notably, this type of MOV is typically restricted for operation at relatively low temperature, such as less than 85° C., and more particularly exhibits reliability problems when operated at bias humidity conditions such as 85° C., 85% relative humidity (RH) and high DC operating voltage. It is believed that the reliability problems experienced under such a bias humidity condition arise from the migration of silver electrode material used to contact surfaces of the ceramic body of the MOV, as well as from the interaction between the epoxy coating and ZnO ceramic. An example of the reliability problems is the increased leakage through the interface when an epoxy-coated MOV is operated at high temperature (at least 85° C.), high humidity conditions while applying DC operating voltage. Moreover, even under lower humidity conditions an epoxy-coated MOV may fail during operation at elevated temperatures, such as 125° C. It is with respect to these and other issues that the present improvements may be desirable.

SUMMARY

Exemplary embodiments are directed to improved varistors. In one embodiment a varistor may include a ceramic body. The varistor may further include a multilayer coating disposed around the ceramic body. The multilayer coating may include a first layer comprising a phenolic material or a silicone material and a second layer adjacent the first layer, the second layer comprising a high dielectric strength coating.

In another embodiment, a method of forming a varistor may include providing a ceramic body and applying a first layer on the ceramic body, applying a multilayer coating around the ceramic body. The multilayer coating may include a first layer comprising a phenolic material or a silicone material, and a second layer adjacent the first layer, where the second layer comprises a high dielectric strength coating.

BRIEF DESCRIPTION OF THE DRAWINGS

FIG. 3A provides the results of electrical measurements of an MOV arranged with a two-layer coating according to the present embodiments at the initial stage;

FIG. 3B provides the results of electrical measurements of the MOV of FIG. 3A after 168 hours under bias conditions;

FIG. 3C provides the results of electrical measurements of the MOV of FIG. 3A after 336 hours under bias conditions;

FIG. 3D provides the results of electrical measurements of the MOV of FIG. 3A after 500 hours under bias conditions;

FIG. 4A provides the results of electrical measurements of a conventional MOV arranged with a single layer epoxy coating at an initial stage;

FIG. 4B provides the results of electrical measurements of the MOV of FIG. 4A after 168 hours under bias conditions;

FIG. 4C provides the results of electrical measurements of the MOV of FIG. 4A after 336 hours under bias conditions;

FIG. 4D provides the results of electrical measurements of the MOV of FIG. 4A after 500 hours under bias conditions; and FIG. 5 provides exemplary formulations for different layers of multi-layer coatings in accordance with embodiments of the disclosure.

DESCRIPTION OF EMBODIMENTS

Figure 1A:
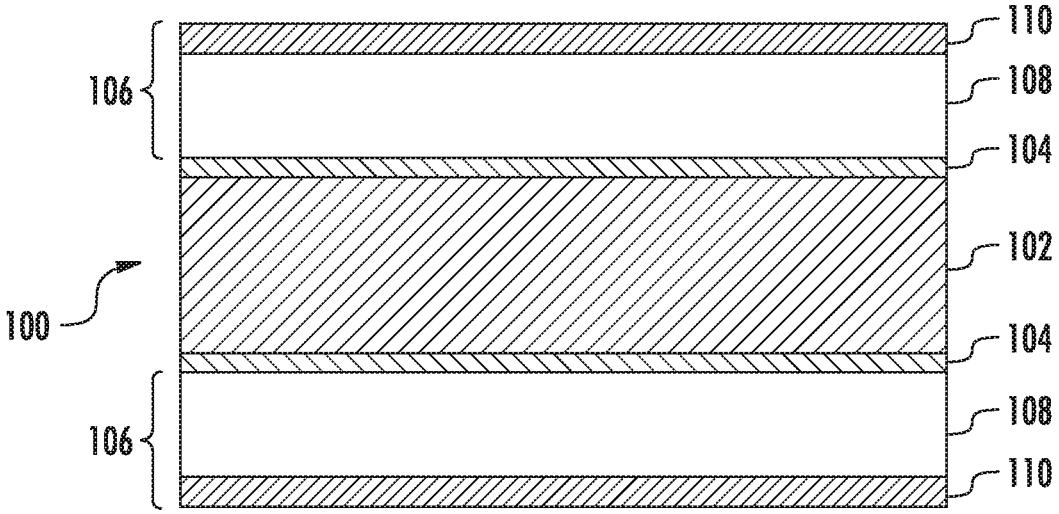
FIG. 1A presents a side cross-sectional view of an MOV according to embodiments of the disclosure.

The present embodiments will now be described more fully hereinafter with reference to the accompanying drawings, in which exemplary embodiments are shown. The embodiments are not to be construed as limited to the embodiments set forth herein. Rather, these embodiments are provided so that this disclosure will be thorough and complete, and will fully convey their scope to those skilled in the art. In the drawings, like numbers refer to like elements throughout.

In the following description and/or claims, the terms "on," "overlying," "disposed on" and "over" may be used in the following description and claims. "On," "overlying," "disposed on" and "over" may be used to indicate that two or more elements are in direct physical contact with one another. Also, the term "on,", "overlying," "disposed on," and "over", may mean that two or more elements are not in direct contact with one another. For example, "over" may mean that one element is above another element while not contacting one another and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

The present embodiments are generally related to metal oxide varistors (MOV) based upon zinc oxide materials. As is known, a varistor of this type comprises a ceramic body whose microstructure includes zinc oxide grains and may include various other components such as other metal oxides that are disposed within the ceramic microstructure. By the way of background, many commercially produced MOVs are primarily comprised of zinc oxide granules that are sintered together to form a disc where the zinc oxide granules, in solid form, constitute a highly conductive material, while the intergranular boundary is formed of other oxides is highly resistive. Just at those points where zinc oxide granules meet does sintering produce a 'microvaristor' which is comparable to symmetrical Zener diodes. The electrical behavior of a metal oxide varistor results from the number of microvaristors connected in series or in parallel. The sintered body of an MOV also explains its high electrical load capacity which permits high absorption of energy and thus, high surge current handling capability.

The aforementioned materials that are employed to contact or encapsulate a ceramic body of the varistor are potential sources of device degradation, especially when operated at high temperature, high humidity, and/or high voltage conditions. In various embodiments, an improved varistor is provided that is resistant to degradation under conditions such as high temperature, high humidity or high voltage. In various embodiments, an MOV is provided that has a coating that includes a multilayer structure, and in particular, a two layer structure. The two layer structure includes a first layer that is formed from a silicone material or a phenolic material, and a second layer that constitutes a high dielectric strength material. The terms "high dielectric strength" or "high dielectric strength material" as used herein refer to a material or quality in which the dielectric strength is at least 20 kV/mm. This multilayer coating may improve resistance to leakage and other electrical degradation as compared to conventional MOVs in which the ceramic is in direct contact with an epoxy coating.

In various embodiments in which the first layer is formed from a silicone material, the silicone material may include an alkyl silicone resin as well as silicon dioxide. The alkyl silicone resin may be a known silicone resin based upon a branched polysiloxane cage-like structure having alkyl groups attached to the polysiloxane structure. In other embodiments, in which the first layer is a phenolic material, the phenolic material may include a phenolic resin that is formed from the reaction of on phenol or substituted phenol with an aldehyde such as formaldehyde. The phenolic material may optionally include up to approximately 10% additive by weight.

In various embodiments the second layer includes an alkyd resin or other high dielectric strength material, such as polyimide or, acrylic resin, whose dielectric strength may exceed 20 kV/mm. In specific embodiments, an alkyd resin may have a dielectric strength of 50 kV/mm. An example of an alkyd resin includes polyester materials derived from the reaction of a polyol with a dicarboxylic acid. Another example of an alkyd resin includes polyester materials derived from the reaction of a polyol with a carboxylic acid anhydride. More generally, an alkyd resin may include other types of polyester resins that are formed using a fatty acid. The embodiments are not limited in this context.

FIG. 1A presents a side cross-sectional view of an MOV, also referred to herein as a "varistor," according to various embodiments of the disclosure. In this example, a varistor 100 includes a ceramic body 102, electrical contact layer 104, and multilayer coating 106. The electrical contact layer 104 may comprise silver or other electrical conductor for providing good electrical contact between the ceramic body 102 and external electrical leads (not shown). In various embodiments, the ceramic body 102 may include a ZnO material. It may be appreciated that the multilayer coating 106 may surround the ceramic body 102 on all sides to provide encapsulation. In the example of FIG. 1A, the multilayer coating 106 includes a first layer 108 that is disposed adjacent to and in contact with the electrical contact layer 104. The first layer 108 may include a silicone material in some embodiments, or may include a phenolic material in other embodiments, as discussed above. Such materials may provide an advantage over conventional epoxy coatings used in present day varistors because the silicone or phenolic material may resist reaction with a ceramic MOV body at elevated temperatures, making them suitable for use applications up to temperatures such as at least 125° C.

In various embodiments, the thickness of the first layer 108 may range from approximately 300 μm to 1200 μm. Notably, silicone and phenolic materials have relatively low dielectric strength, such as between 5 kV/mm and 10 kV/mm, in comparison to conventional epoxy coatings that are used to coat a varistor ceramic body. Accordingly, the second layer 110 may include an alkyd resin or other high dielectric strength material that imparts an overall dielectric strength to the multilayer coating 106 that is appropriate for use as a varistor. In some embodiments, the second layer 110 has a thickness of 20 μm to 150 μm, which is adequate to impart a high dielectric strength to the multilayer coating 106 in conjunction with the first layer 108. For example, in some embodiments, the multilayer coating 106 has a dielectric strength that exceeds 2500 V ac.

In various embodiments, the first layer and second layer may be applied as liquid or viscous layers to the surface of a ceramic body 102 after the electrical contact layer 104 is applied. Incorporating a second layer 110 that has a high dielectric strength into a multilayer coating 106 provides advantages over the use of a single layer such as a silicone or phenolic layer for encapsulating the ceramic body 102. In particular, the overall coating thickness may be reduced in a multilayer coating having a high dielectric strength layer. For example, in the absence of the use of a high dielectric strength layer such as the second layer 110, a thickness of 3 mm or more may be needed for a silicone or phenolic layer to impart a target dielectric strength for various applications, such as 2500 V ac. This is in part due to the fact that the silicone layer may have a relatively low dielectric strength, such as 10 kV/mm or less, and the fact that coating thickness around an MOV ceramic may vary drastically, especially in corner regions of an MOV. Accordingly, in order to ensure that a single layer coating would meet a specification such as 2500 Vac, it may be needed to apply an average coating thickness many times that of the theoretical thickness needed to withstand 2500 V if the coating were uniform. For example, it has been observed that in a MOV having a rectangular ceramic body, a silicone layer thickness may vary between 100 μm in corner regions to 1 mm in other regions.

Advantageously, an MOV having a multilayer coating according to the present embodiments may have a dielectric strength of 2500 Vac when coating thickness of the multilayer coating is 1.0 mm (1000 μm) or less. The thinner coating thickness afforded by the multilayer coating 106 provides a less bulky varistor and provides easier handling and higher yield in a mass production environment. For example, a 50 μm thick alkyd layer having a dielectric strength of 50 kV/mm imparts a dielectric strength of 2500 V by itself. Accordingly, the thickness of a silicone or phenolic layer in a multilayer coating that includes a 50 μm thick alkyd layer need just be adequate to protect the ceramic body and electrical contact layer against reaction, since the needed dielectric strength is provided by the alkyd layer alone. Moreover, it has been observed that the thickness of an alkyd layer applied to an inner silicone layer is more uniform that the thickness of the inner silicone layer. For example, in the above example where silicone layer thickness varied by approximately a factor of ten, an alkyd layer applied to the silicone layer exhibited a variation in thickness between 50 μm in corner regions and 110 μm in other regions, or just a factor of approximately 2, with most measurements yielding a thickness between 50-70 μm. Thus, a nominal 70 μm thick alkyd layer having a dielectric strength of 50 kV/mm may be adequate to ensure that all regions of the alkyd layer have adequate thickness (>50 μm) to meet 2500 V ac independent of the thickness of the inner silicone layer.

Figure 1B:
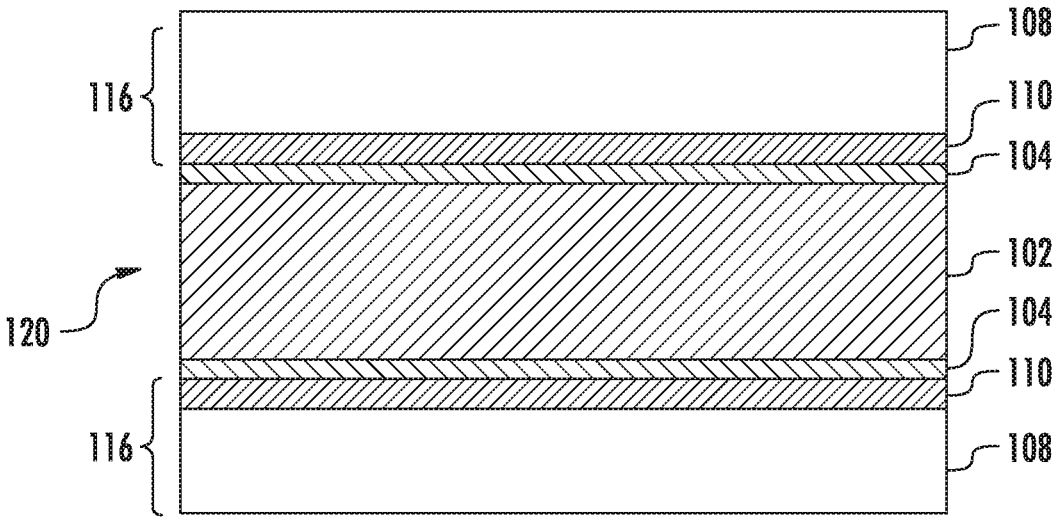
FIG. 1B presents a side cross-sectional view of another MOV according to other embodiments of the disclosure.

Because a silicone material or phenolic material may resist reaction with a ceramic body of a varistor, it may be advantageous to provide a multilayer coating as shown in FIG. 1A in which the first layer 108 that comprises a silicone or phenolic material is adjacent the electrical contact layer 104. In other embodiments, the second layer 110 may be disposed adjacent the electrical contact layer 104. FIG. 1B depicts an embodiment of a varistor 120 in which a multilayer coating 116 has an arrangement in which the high dielectric strength layer, the second layer 110, is disposed adjacent the electrical contact layer 104, while the first layer 108 is disposed around the second layer 110. This arrangement may provide a similar dielectric strength to that of the multilayer coating 106 given the same thickness of second layer 110 and first layer 108. The coatings of varistor 120 may be less stable than those of varistor 100 under certain conditions, and the ability to minimize delamination or bubbling may be a challenge under certain use conditions.

It is to be noted that an alkyd resin in particular may not be reliable for use as the second layer 110 in the embodiment of FIG. 1B. This is because the alkyd layer may not form a strong interfacial bond with a silicone layer. Accordingly, when an outer silicone layer having a thickness in the range of 500 μm to 1 mm, for example, is applied as the first layer 112, the silicone layer may flow away before solidification takes place. In the embodiment of FIG. 1A, although a second layer 110 made from alkyd resin may not form a strong bond with the first layer 108, the thickness of the second layer 110 is relatively low, such as 50-100 μm, which does not need a high strength bond in order to retain the second layer 110 in place. Other materials that have high dielectric strength and high bonding with silicone may also be suitable for use as the second layer 110 in the embodiment of FIG. 1B.

Figure 2A:
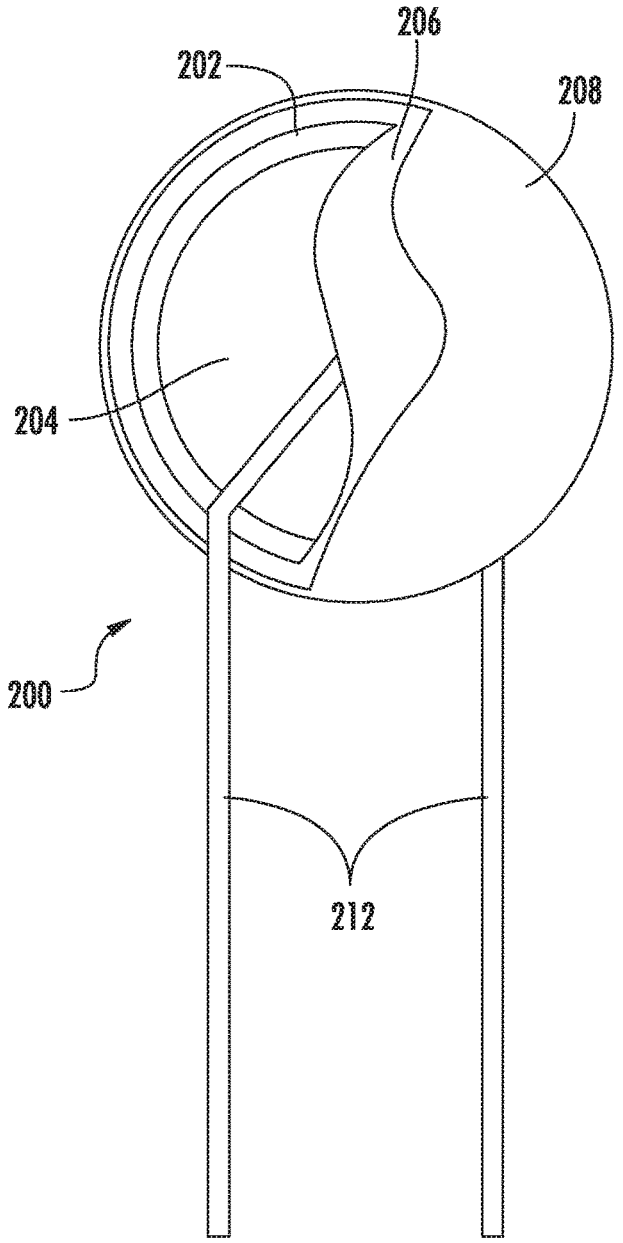
FIG. 2A presents a plan view of an additional MOV according to embodiments of the disclosure.
Figure 2B:
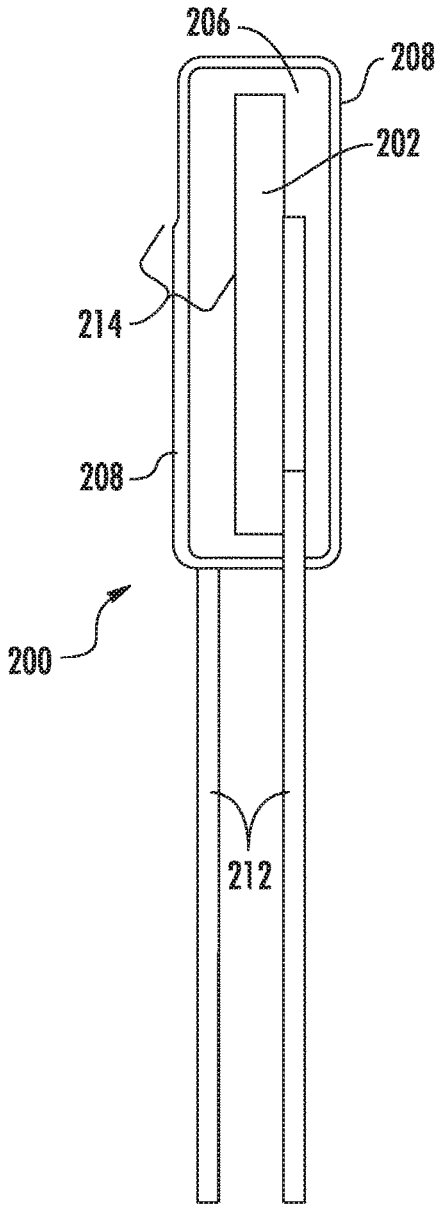
FIG. 2B presents a side cross-sectional view of the MOV of FIG. 2A.

FIG. 2A presents a plan view of an additional MOV according to embodiments of the disclosure. FIG. 2B presents a side cross-sectional view of the MOV of FIG. 2A. As shown in FIG. 2A a varistor 200 includes a circular disc for a ceramic body 202, electrical contact layer 204, and multilayer coating 214. The electrical contact layer 204 is not explicitly depicted in FIG. 2B. In turn, the multilayer coating 214 includes a first layer 206 that is disposed adjacent the electrical contact layer 204. The first layer 206 may include a silicone material or phenolic material as generally discussed above with respect to FIGS. 1A and 1B. As in the embodiment of FIG. 1A, the first layer 206 may have a thickness in the range from approximately 300 μm to 1200 μm. The multilayer coating 214 also includes a second layer 208 disposed around the first layer 206, in which the second layer 208 has a relatively high dielectric strength, such as above 20 kV/mm.

As further shown in FIG. 2A and FIG. 2B, a pair of electrical leads, shown as the leads 212 are disposed in contact with opposite sides of the ceramic body 202, which form electrical contact through the electrical contact layer 204.

In operation, a varistor such as varistor 100 or varistor 200 may provide superior electrical performance with respect to a conventional varistor in which a ceramic body is encapsulated by an epoxy layer. A particular advantage provided by the MOV devices according to the present embodiments is the improved performance under various high temperature and high voltage conditions. FIGS. 3A-3D present the results of electrical measurements of a set of MOV samples arranged with a multilayer coating in accordance with the present embodiments. In these results, the multilayer coating is made from an inner layer (first layer) made of a silicone material and an outer layer made of an alkyd resin. The silicone material in turn includes an alkyl silicone resin as discussed above, as well as silicon dioxide filler. The thickness of the inner silicone layer in the varistor samples along the opposite surfaces of a ceramic body as exemplified by surfaces 130, 132 of FIG. 1A may range from 490 μm to 820 μm, while the thickness of the outer alkyd resin layer may range from 50 μm to 110 μm.

The results of FIGS. 3A-3D include measurements under a high temperature loading test (125° C. with 970 V DC applied), and bias humidity loading test (85° C., 85% RH, with applied voltage of 970 V DC). The MOV samples were subjected to various measurements at intervals of approximately 168 hrs while subject to applied bias. In particular, in one set of tests the MOV samples 11-20 were subject to application of 970 V continuous dc bias at 85° C. in an ambient of 85% relative humidity, while in another set of tests the samples 1-10 were maintained at 125° C. with continuous 970 V DC applied. Samples were removed and measured at intervals of approximately 168 hrs as noted. In the data shown, Vnom represents the voltage drop across an MOV when 1 mA current is conducted through the MOV, and leakage current is measured at 80% Vnom.

In FIG. 3A a set of samples 1-20 were measured for varistor voltage (Vnom) at 1 mA current, under forward bias and reverse-bias conditions. Leakage measurements are also shown under forward bias and reverse-bias conditions. The initial Vnom values exhibit an average of approximately 1195 under forward bias and 1198 under reverse bias. These values increase marginally with time up to 500 hrs by approximately 1.0% and 3.8%, respectively.

The leakage current (shown in microAmperes) is measured at a bias voltage of 80% Vnom, with forward leakage and reverse leakage recorded. The initial leakage values under reverse bias conditions exhibit an average value of approximately 15 and decrease slightly as a function of time up to 500 hrs. The initial leakage values under forward bias exhibit an average value of approximately 17, which decreases slightly at 168 hrs. At 336 hrs, the average leakage under forward bias conditions increases moderately to approximately 43, while at 500 hrs this value increases to about 62. The increases in average leakage at 336 hrs and 500 hrs is due to increases in samples 11-20 that were subjected to the 970 V continuous dc bias at 85° C. in an ambient of 85% relative humidity. Samples 1-10, which were subjected to 125° C. with continuous 970 V DC, showed a slight decrease in leakage under forward bias conditions at 168 hrs, 336 hrs, and 500 hrs.

FIG. 4A-FIG. 4D provide the results of electrical measurements of a conventional MOV arranged with a coating that contains a single epoxy layer. A set of samples 47, 48, 49, 50, and 51 were measured using the same measurement conditions as shown in FIGS. 3A-3D for samples 11-20. As illustrated in FIG. 4A, the initial average Vnom measurements (1185, 1195) show similar values to those of their counterparts in samples 11-20, and leakage measurements exhibit slightly higher values of approximately 34 and 33 under forward and reverse bias, respectively.

The electrical properties change substantially as a function of time, as shown in FIGS. 4B, 4C, and 4D. For example, after 500 hrs, Vnom under reverse-bias conditions decreases by approximately 8% and under forward bias conditions Vnom decreases by approximately 54%. Moreover, after 500 hrs, under reverse bias and forward bias conditions, leakage increases by more than a factor of 10, indicating severe device degradation.

In view of the above results, it is clear that the varistor samples (1-10) arranged with a multilayer coating according to the present embodiments are stable against degradation as measured by Vnom or leakage for at least 500 hours at 125° C. with 970 V DC applied. Moreover, under 85° C., 85% RH, with applied voltage of 970 V DC, the varistor samples 11-20 are stable against shifts in Vnom and reverse bias leakage up to 500 hrs, and are stable against increase in forward bias leakage up to a period between 168 hr and 336 hr. Disadvantageously, as noted, conventional varistor samples having an epoxy coating exhibit large degradation even at 168 hr, in Vnom under forward bias (30%), and in leakage (>1000%).

In addition to the above advantages shown in the electrical property measurements, the two-layer coating of the present embodiments exhibits superior stability under thermal cycling tests as opposed to a conventional varistor coated by a single epoxy layer. In one set of thermal cycling experiments samples were subject to cycling in which one cycle is composed of four steps: 1) 15 min @ −40° C.; 2) 5 min @ room temperature; 3) 15 min @ 125° C.; and 4) 5 min @ room temperature. Varistor samples were subject to 5 cycles, 15 cycles, 50 cycles, 100 cycles, and 200 cycles. Varistor samples having a multilayer coating in which the inner layer includes a silicone material as disclosed herein, and an outer layer having an alkyl resin exhibited no failures even after 200 cycles. Disadvantageously, conventional varistor samples exhibit fails after just 5 cycles.

In various embodiments a multilayer coating may be applied to a varistor ceramic body (including electrical contact layers) using known solution-based techniques. For example, a varistor ceramic body may be dipped in a solution including a resin of a layer to be applied to the varistor. In one instance, a silicone or phenolic layer may be applied to the varistor ceramic body as a viscous liquid coating that is made from a solvent mixture that contains either an alkyl silicone resin or phenolic resin, respectively. The coating may subsequently be baked to form a solid layer. Subsequently, an alkyd layer may be applied to the outer surface of the silicone or phenolic layer as a viscous liquid containing a solution of an alkyd resin, and may be subsequently baked to solidify the alkyd layer. The embodiments are not limited in this context.

FIG. 5 provides exemplary formulations for different layers of multi-layer coatings in accordance with embodiments of the disclosure. The formulation 502 presents compositions for a silicone layer to be used in conjunction with a high dielectric strength layer, which is shown as the conformal coating formulation 506. The formulation includes an alkyl silicone resin, together with silicon dioxide, as well as various solvents, including isopropyl alcohol (IPA), and optional additives. The embodiments are not limited in this context. It is to be noted that the formulations shown in FIG. 5 present formulations of a solution to be applied to the varistor ceramic body before drying/curing. Accordingly, at least a portion of the solvents may be removed during formation of the final multilayer coating. A phenolic formulation 504 may also be used in conjunction with the conformal coating formulation to form a multi-layer coating. The phenolic formulation 504 may include a phenolic resin, solvents, and optional additives as shown. The embodiments are not limited in this context. Finally, the conformal coating formulation 506 includes an alkyd resin, solvents, as well as optional additives.

While the present embodiments have been disclosed with reference to certain embodiments, numerous modifications, alterations and changes to the described embodiments are possible without departing from the sphere and scope of the present disclosure, as defined in the appended claims. Accordingly, it is intended that the present embodiments not be limited to the described embodiments, and that it has the full scope defined by the language of the following claims, and equivalents thereof.

What is claimed is:

1. A varistor, comprising:
a ceramic body; and
a multilayer coating disposed around the ceramic body, the multilayer coating comprising:
an inner first layer comprising a phenolic resin or a silicone resin; and
an outer second layer directly adjacent the first layer, the outer second layer comprising an alkyd resin with high dielectric strength.

2. The varistor of claim 1, wherein the ceramic body comprises a ZnO ceramic.

3. The varistor of claim 1, wherein the first layer comprises a thickness of 300 μm to 1200 μm.

4. The varistor of claim 1, wherein the second layer comprises a thickness of 20 μm to 150 μm.

5. The varistor of claim 1, further comprising an electrical contact layer disposed on the ceramic body, wherein the first layer is disposed adjacent the electrical contact layer.

6. The varistor of claim 1, wherein the multilayer coating comprises a dielectric strength of 2500 Vac or greater.

7. The varistor of claim 1, wherein the multilayer coating comprises a thickness of 1.0 mm or less.

8. The varistor of claim 1, wherein the first layer comprises an alkyl silicone resin and a silicon dioxide filler.

9. A method of forming a varistor, comprising:
providing a ceramic body;
applying a multilayer coating around the ceramic body, the multilayer coating comprising:
an inner first layer comprising a phenolic resin or a silicone resin; and
an outer second layer directly adjacent the first layer, the outer second layer comprising an alkyd resin with high dielectric strength.

10. The method of claim 9, wherein the ceramic body comprises a ZnO ceramic.

11. The method of claim 9, wherein the first layer comprises a thickness of 300 μm to 1200 μm.

12. The method of claim 9, wherein the second layer comprises a thickness of 20 μm to 150 μm.

13. The method of claim 9, further comprising applying an electrical contact layer to the ceramic body before the applying a multilayer coating, wherein the first layer is applied adjacent to the electrical contact layer.

14. The method of claim 9, wherein the multilayer coating comprises a dielectric strength of 2500 Vac or greater.

15. The method of claim 9, wherein the multilayer coating comprises a thickness of 1.0 mm or less.

16. The method of claim 9, wherein the second layer comprises an alkyl Silicone resin and a silicon dioxide filler.

17. The method of claim 9, wherein the applying the multilayer coating comprises:

providing the first layer as a first solvent mixture comprising an alkyl silicone resin or a phenolic resin, providing the second layer as a second solvent mixture comprising an alkyd resin; and baking the first layer to form a first solid layer before the providing the second layer; and baking the second layer to form a second solid layer.

* * * * *